US012521840B2

(12) United States Patent
Bubel et al.

(10) Patent No.: US 12,521,840 B2
(45) Date of Patent: Jan. 13, 2026

(54) TWO COMPONENT CHEMICAL MECHANICAL POLISHING

(71) Applicant: Wolfspeed, Inc., Durham, NC (US)

(72) Inventors: Simon Bubel, Carrboro, NC (US); Dinusha Priyadarshani Karunaratne, Cary, NC (US)

(73) Assignee: WOLFSPEED, INC., Durham, NC (US)

( * ) Notice: Subject to any disclaimer, the term of this patent is extended or adjusted under 35 U.S.C. 154(b) by 0 days.

(21) Appl. No.: 18/598,804

(22) Filed: Mar. 7, 2024

(65) Prior Publication Data

US 2025/0282022 A1 Sep. 11, 2025

(51) Int. Cl.

| | |
|---|---|
| ***B24B 37/26*** | (2012.01) |
| ***B24B 37/005*** | (2012.01) |
| ***B24B 37/22*** | (2012.01) |
| ***B24B 37/24*** | (2012.01) |
| ***B24B 57/02*** | (2006.01) |

(52) U.S. Cl.

CPC ..... *B24B 37/26* (2013.01); *B24B 37/005* (2013.01); *B24B 37/245* (2013.01); *B24B 57/02* (2013.01); *B24B 37/22* (2013.01)

(58) Field of Classification Search

CPC ..... B24B 7/228; B24B 37/005; B24B 37/04; B24B 37/042; B24B 37/10; B24B 37/107; B24B 37/34; B24B 57/02

See application file for complete search history.

(56) References Cited

U.S. PATENT DOCUMENTS

| | | | | |
|---|---|---|---|---|
| 5,645,682 | A * | 7/1997 | Skrovan | B24B 53/017 438/692 |
| 5,785,585 | A * | 7/1998 | Manfredi | B24B 53/017 451/286 |
| 5,866,480 | A * | 2/1999 | Murakami | B24B 37/04 438/747 |
| 5,879,226 | A * | 3/1999 | Robinson | B24B 37/04 438/692 |
| 5,928,062 | A * | 7/1999 | Miller | B24B 37/107 451/287 |
| 5,938,507 | A * | 8/1999 | Ko | B24B 53/017 451/287 |
| 6,284,092 | B1 * | 9/2001 | Manfredi | B24B 57/02 451/446 |
| 6,293,851 | B1 * | 9/2001 | Molnar | B24B 37/013 451/287 |

(Continued)

OTHER PUBLICATIONS

Disco, "Chemical-Free Stress Relief Dry Polishing Wheel", DP08 Series Product Inforamtion, https://www.discousa.com/eg/products/dry_wheel/dp08.html, retrieved on Mar. 7, 2024, 3 pages.

(Continued)

*Primary Examiner* — Joel D Crandall

(74) *Attorney, Agent, or Firm* — Dority & Manning, P.A.

(57) ABSTRACT

Systems and methods for polishing semiconductor workpieces are provided. In one example, the polishing system includes a platen operable to rotate about an axis. The polishing system further includes a polishing pad on the platen. The polishing system further includes a workpiece carrier operable to bring a semiconductor workpiece into contact with the polishing pad. The polishing pad includes a first zone and a second zone.

18 Claims, 7 Drawing Sheets

(56) References Cited

U.S. PATENT DOCUMENTS

| | | | | |
|---|---|---|---|---|
| 6,364,744 | B1 * | 4/2002 | Merchant | C09K 3/1463 451/6 |
| 6,458,020 | B1 * | 10/2002 | Brigante | B24B 37/04 451/60 |
| 6,887,132 | B2 * | 5/2005 | Kajiwara | B24B 37/04 451/60 |
| 7,011,566 | B2 * | 3/2006 | Chandrasekaran | B24B 49/10 451/10 |
| 10,500,694 | B2 * | 12/2019 | Bajaj | B24B 37/044 |
| 10,576,585 | B1 | 3/2020 | Donofrio et al. | |
| 11,219,966 | B1 | 1/2022 | Donofrio et al. | |
| 11,654,596 | B2 | 5/2023 | Bubel et al. | |
| 11,901,181 | B2 | 2/2024 | Donofrio et al. | |
| 2001/0036804 | A1 * | 11/2001 | Mueller | B24D 3/34 451/526 |
| 2002/0137435 | A1 * | 9/2002 | Hu | B24D 7/10 451/36 |
| 2003/0077988 | A1 * | 4/2003 | Gotkis | B24B 53/017 451/60 |
| 2009/0137191 | A1 * | 5/2009 | Lee | C11D 7/3263 451/36 |
| 2016/0136787 | A1 * | 5/2016 | Bajaj | B33Y 70/00 51/298 |
| 2016/0167195 | A1 * | 6/2016 | Diao | B24B 53/017 216/53 |
| 2017/0368663 | A1 * | 12/2017 | Yang | B24B 57/02 |

OTHER PUBLICATIONS

Rena, "Ace Advanced Electrochemical Etching for SiC-Wafers", https://www.rena.com/en/technology/innovations/sic-electrochemical-etching, retrieved on Mar. 7, 2024, 5 pages.

Son et al., "Contact-Area-Changeable CMP Conditioning for Enhancing Pad Lifetime", Applied Sciences MDPI, vol. 11, No. 3521, Apr. 14, 2021, pp. 1-15.

Zhu et al., "Grinding Marks in Back Grinding of Wafer with Outer Rim", Institute of Mechanical Engineers, Journal of Mechanical Engineering Science, Jan. 27, 2020, pp. 1-12.

* cited by examiner

TWO COMPONENT CHEMICAL MECHANICAL POLISHING

FIELD

The present disclosure relates generally to semiconductor workpieces and fabrication processes for semiconductor workpieces, such as semiconductor wafers used in semiconductor device fabrication.

BACKGROUND

Power semiconductor devices may carry large currents and support high voltages. A wide variety of power semiconductor devices are known in the art including, for example, transistors, diodes, thyristors, power modules, discrete power semiconductor packages, and other devices. For instance, example semiconductor devices may be transistor devices such as Metal Oxide Semiconductor Field Effect Transistors ("MOSFET"), bipolar junction transistors ("BJTs"), Insulated Gate Bipolar Transistors ("IGBT"), Gate Turn-Off Transistors ("GTO"), junction field effect transistors ("JFET"), high electron mobility transistors ("HEMT") and other devices. Example semiconductor devices may be diodes, such as Schottky diodes or other devices. Example semiconductor devices may be power modules, which may include one or more power devices and other circuit components and can be used, for instance, to dynamically switch large amounts of power through various components, such as motors, inverters, generators, and the like. These semiconductor devices may be fabricated from wide bandgap semiconductor materials, such as silicon carbide ("SiC") and/or Group III nitride-based semiconductor materials. The fabrication process may require processing of wide bandgap semiconductor wafers, such as silicon carbide semiconductor wafers.

SUMMARY

Aspects and advantages of embodiments of the present disclosure will be set forth in part in the following description, or may be learned from the description, or may be learned through practice of the embodiments.

One example aspect of the present disclosure is directed to a polishing system for a semiconductor workpiece. The polishing system includes a platen operable to rotate about an axis. The polishing system further includes a polishing pad on the platen. The polishing system further includes a workpiece carrier operable to bring a semiconductor workpiece into contact with the polishing pad. The polishing pad comprises a first zone and a second zone.

Another example aspect of the present disclosure is directed to a polishing system for a semiconductor workpiece. The polishing system includes a platen operable to rotate about an axis. The polishing system further includes a polishing pad on the platen. The polishing system further includes a workpiece carrier operable to bring a semiconductor workpiece into contact with the polishing pad. The polishing system further includes a controller configured to control an actuator to perform operations. The operations include activating an oxidation process on the semiconductor workpiece for a first process period. The operations further include activating an oxide removal process on the semiconductor workpiece for a second process period.

Another example aspect of the present disclosure is directed to a method for polishing a surface of a workpiece. The method includes providing a surface of a workpiece on a polishing pad. The method further includes imparting relative motion between the polishing pad and the workpiece. The method further includes providing an oxidizing material to the polishing pad. The method further includes providing an oxide removal material to the polishing pad in a time separated manner or a spatially separated manner relative to providing the oxidizing material to the polishing pad.

Another example aspect of the present disclosure is directed to a method of polishing a workpiece. The method includes providing a surface of a workpiece on a polishing pad. The method further includes imparting relative motion between the polishing pad and the workpiece. The method further includes providing an actuatable material to the polishing pad. The method further includes activating the actuatable material in a pulsed manner to provide a time separation between a first process and a second process on the workpiece.

These and other features, aspects and advantages of various embodiments will become better understood with reference to the following description and appended claims. The accompanying drawings, which are incorporated in and constitute a part of this specification, illustrate embodiments of the present disclosure and, together with the description, explain the related principles.

BRIEF DESCRIPTION OF THE DRAWINGS

Detailed discussion of embodiments directed to one of ordinary skill in the art are set forth in the specification, which refers to the appended figures, in which.

DETAILED DESCRIPTION

Figure 1:
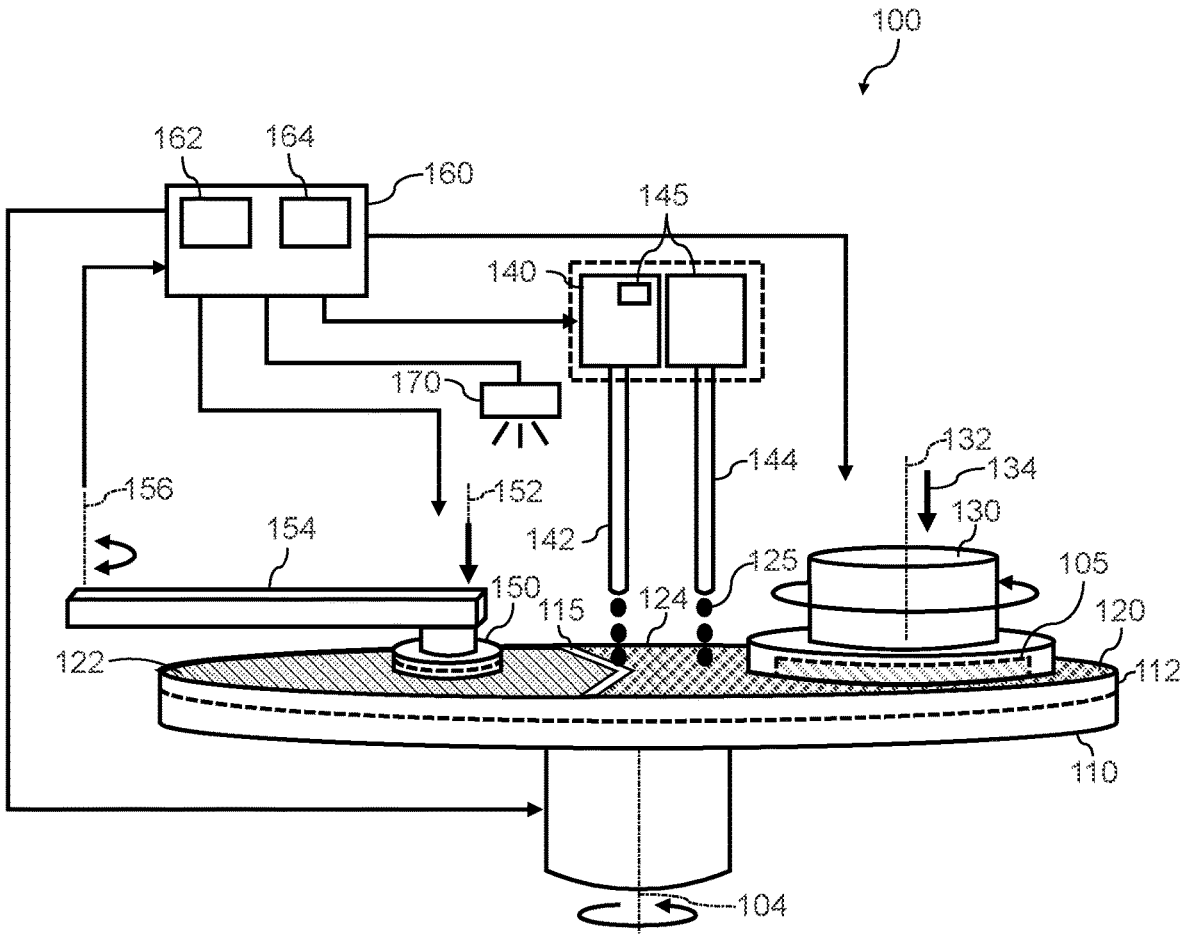
FIG. 1 depicts an example polishing system for a semiconductor workpiece according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment.

Thus, it is intended that aspects of the present disclosure cover such modifications and variations.

Power semiconductor devices are often fabricated from wide bandgap semiconductor materials, such as silicon carbide or Group III-nitride based semiconductor materials (e.g., gallium nitride). Herein, a wide bandgap semiconductor material refers to a semiconductor material having a bandgap greater than 1.40 eV. Aspects of the present disclosure are discussed with reference to silicon carbide-based semiconductor structures as wide bandgap semiconductor structures. Those of ordinary skill in the art, using the disclosures provided herein, will understand that example embodiments of the present disclosure may be used with any semiconductor material, such as other wide bandgap semiconductor materials, without deviating from the scope of the present disclosure. Example wide bandgap semiconductor materials include silicon carbide and the Group III-nitrides.

Power semiconductor devices may be fabricated using epitaxial layers formed on a semiconductor workpiece, such as a silicon carbide semiconductor wafer. Power semiconductor device fabrication processes may include surface processing operations that are performed on the silicon carbide semiconductor wafer to prepare one or more surfaces of the silicon carbide semiconductor wafer for later processing steps, such as surface implantation, formation of epitaxial layers, metallization, etc. Example surface processing operations may include grinding operations, lapping operations, and polishing operations.

Aspects of the present disclosure are discussed with reference to a semiconductor workpiece that is a semiconductor wafer that includes silicon carbide ("silicon carbide semiconductor wafer") for purposes of illustration and discussion. Those of ordinary skill in the art, using the disclosures provided herein, will understand that aspects of the present disclosure can be used with other semiconductor workpieces. Other semiconductor workpieces may include carrier substrates, ingots, boules, polycrystalline substrates, monocrystalline substrates, bulk materials having a thickness of greater than 1 mm, such as greater than about 5 mm, such as greater than about 10 mm, such as greater than about 20 mm, such as greater than about 50 mm, such as greater than about 100 mm, to 200 mm, etc.

Grinding is a material removal process that is used to remove material from the semiconductor wafer. Grinding may be used to reduce a thickness of a semiconductor wafer. Grinding typically involves exposing the semiconductor wafer to an abrasive containing surface, such as grind teeth on a grind wheel. Grinding may remove material of the semiconductor wafer through engagement with the abrasive surface.

Lapping is a precision finishing process that uses a loose abrasive in slurry form. The slurry typically includes coarser particles (e.g., largest dimension of the particles being greater than about 100 microns) to remove material from the semiconductor wafer. Lapping typically does not include engaging the semiconductor wafer with an abrasive-containing surface on the lapping tool (e.g., a wheel or disc having an abrasive-containing surface). Instead, the semiconductor wafer typically comes into contact with a lapping plate or a tile usually made of metal. Lapping typically provides better planarization of the semiconductor wafer relative to grinding.

Polishing is a process to remove imperfections and create a smooth surface with a low surface roughness. Polishing may be performed using a slurry and a polishing pad. The slurry typically includes finer particles relative to lapping, but coarser particles relative to chemical mechanical planarization (CMP). Polishing typically provides better planarization of the semiconductor wafer relative to grinding.

CMP is a type of fine or ultrafine polishing, typically used to produce a smoother surface ready, for instance, for epitaxial growth of layers on the semiconductor wafer. CMP may be performed chemically and/or mechanically to remove imperfections and to create a smooth and flat surface with low surface roughness. CMP typically involves changing the material of the semiconductor through a chemical process (e.g., oxidation) and removing the new material from the semiconductor wafer through abrasive contact with a slurry and/or other abrasive surface or polishing pad (e.g., oxide removal). In CMP, the abrasive elements in the slurry typically remove the product of the chemical process and do not remove the bulk material of the semiconductor wafer, often leaving reduced subsurface damage.

Polishing tools (e.g., such as chemical mechanical polishing (CMP) tools) may be used after grinding operations to polish and/or smooth a semiconductor wafer surface. Polishing tools, such as CMP tools, may use a combination of chemical and mechanical forces to remove excess materials from a wafer surface, ensuring desired flatness and smoothness. Polishing tools, such as CMP tools, may include a rotating platen, polishing pad, and a slurry containing abrasive particles and chemical agents. As the wafer is pressed against the polishing pad and rotated, the slurry chemically reacts with and/or mechanically removes material, resulting in a highly planar and smooth surface.

Grinding and polishing silicon carbide semiconductor wafers may pose several challenges due to the inherent properties of the material. Silicon carbide is an extremely hard and brittle compound with a prominent level of abrasiveness, making the polishing process more demanding. One challenge is the potential for excessive tool wear and heat generation during grinding or polishing, which can affect the quality of the finished product. The hardness of silicon carbide may also lead to the formation of cracks or fractures if not properly managed, impacting the structural integrity of the material. Additionally, achieving precise dimensions and surface finishes can be challenging due to the resistance of silicon carbide to abrasion. Controlling parameters such as polishing pad selection, rotational speed, slurry composition, and/or cooling mechanisms may be important to overcoming these challenges and ensuring the successful fabrication of silicon carbide components with the desired properties and performance.

Some systems and methods for polishing wafers may pose several challenges unique to polishing processes. For instance, polishing semiconductor wafers may require performing several different polishing processes on the semiconductor wafer in an alternating fashion. For instance, certain polishing processes may include an oxidation process followed by an oxide removal process. The oxidation process may form a thin oxide layer to aid in planarization of the semiconductor wafer surface. The oxide removal process may use one or more abrasives (e.g., as part of the slurry and/or the polishing pad) and/or oxide removal chemistry to remove the oxide layer from the semiconductor wafer surface during the polishing process to smooth the surface of the semiconductor wafer.

For instance, in some examples, a slurry used during the polishing process may need to be effective as an oxidizing material for silicon carbide but at the same time, needs to be effective in stabilizing the oxide removal process. If the oxide removal process is using an abrasive particle, the properties of a slurry designed for oxidation may limit the possible chemistry of abrasive particles. At the same time, using abrasive particles in the slurry requires a stabilizing or dispersion agent which again, may not be selected to increase slurry stability but rather to be compatible with the oxidizing properties of the slurry. Even in nominally abrasive-free slurries (e.g., potassium permanganate slurries), manganese oxide may be formed, which acts as an abrasive particle and may be difficult to control (e.g., prevents the re-use of the slurry through filtration as manganese oxide may be formed in all possible sizes). In addition to the difficulty in combining good oxidizing action and particle dispersion simultaneously, it may be difficult to employ other additives or chemicals that effectively dissolve the oxide formed during oxidation. In addition, in some examples, the abrasive elements in a slurry may coagulate or precipitate, leading to tool contamination, clogging, or workpiece scratching via larger abrasive agglomerates.

Accordingly, example aspects of the present disclosure are directed to polishing tools (e.g., CMP tools) that are adapted to implement one or more polishing processes on a silicon carbide wafer. For instance, a polishing system may include a CMP tool including a platen with a polishing pad for polishing silicon carbide semiconductor wafers and a workpiece carrier to bring a surface of a silicon carbide semiconductor wafer against the polishing pad on the platen. The platen with the polishing pad may be operable to rotate about an axis. The platen and/or the polishing pad may include multiple zones with each zone being associated with its own process. For example, the platen and/or polishing pad may include a first zone associated with a first process and a second zone associated with a second process. The first process may be, for instance, an oxidation process, an anodization process, electrochemical oxidation process, or other process. The second process may be, for instance, an oxide removal process, a reduction process, or other process.

Aspects of the present disclosure are discussed with reference to an oxidation process as a first process and an oxide removal process as a second process. Those of ordinary skill in the art, using the disclosures provided herein, will understand that aspects of the present disclosure may implement other processes, such as anodization processes, electrochemical processes, reductions processes, etc., without deviating from the scope of the present disclosure.

In some instances, an oxidizing material may be deposited on and/or otherwise provided on the polishing pad in the first zone of the polishing pad. For instance, in some embodiments, the oxidizing material may be a part of or integrated into the polishing pad. Similarly, in some instances, an oxide removal material and/or abrasive containing material may be deposited on and/or otherwise provided on the polishing pad in the second zone of the platen. For instance, in some embodiments, the oxide removal material may be a part of or integrated into the polishing pad.

In some examples, the platen may include a separator that divides the platen into two or more zones. For example, the platen may include a separator that divides the platen and/or the polishing pad into a first zone and a second zone. The separator may come in a variety of forms. For instance, the separator may be a fluid blade operable to inject a separator fluid away from the platen creating separated regions or zones on the platen. The separator fluid may be, for example, air, water, liquid, gas, or any other fluid capable of maintaining separation between different zones on the platen. In some examples, the fluid is a neutralizing substance that may be used, for instance, to reduce undesirable reactions. In some embodiments, the separator may include a lip that protrudes from the platen. The lip may be made of, for instance, polymer, silicon, rubber, or plastic. The separator may be distributed across the platen in a variety of ways. For instance, the separator may pass through the center of the platen and may divide the platen into equal or into unequal portions. Further, in some instances, the separator may create a first zone with a different size relative to the second zone.

The polishing system may include a delivery system (e.g., slurry delivery system) that may deposit one or more materials (e.g., a slurry and/or oxidizing agents, oxide removal agents, etc.) onto the platen. In some embodiments, the delivery system may be operable to deliver an oxidizing material or oxidizing agents (e.g., with the slurry or separate from the slurry) to a first zone of the polishing pad and an oxide removal material (e.g., with the slurry or separate from the slurry) to a second zone of the polishing pad. In some examples, the oxidizing agent may include, for instance, one or more of hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate. In some examples, the oxidizing agent may include an organic peroxide, such as one or more of benzoyl peroxide or dimethyl peroxide. In some examples, the oxidizing agent includes hydrogen peroxide that may or may not be exposed to one or more $Fe^{+2}$ compounds. In some examples the oxidizing agent (e.g., hydrogen peroxide) may include additional chemical elements to improve their oxidizing properties, such as $NaHCO_3$ and/or $KHCO_3$. In some examples, the oxide removal material may include one or more abrasive elements (e.g., abrasive particles), for instance, provided as part of a slurry. In some examples, the oxide removal material may include one or more etchants for etching an oxide, such as acid-based etchants (with or without a buffer), such as fluorine containing etchants (e.g., hydrofluoric acid, fluoroantimonic acid, ammonium bifluoride), caustic compounds (e.g., sodium hydroxide and/or potassium hydroxide), or other etchants.

In some examples, the polishing system may additionally include a controller configured to operate the polishing system. For instance, the controller may control a delivery system within the polishing system based, at least in part, on a position of a first zone on the polishing pad and a second zone on the polishing pad. For example, the controller may control the delivery system to deposit one or more materials on the platen based on the location of the first zone or second zone relative to the delivery system. For instance, the delivery system may provide oxidizing materials to the first zone of the polishing pad when the polishing pad passes under a delivery outlet associated with delivery of the oxidizing materials. The delivery system may be controlled to provide oxide removal materials to the second zone of the polishing pad when the polishing pad passes under a delivery outlet associated with delivery of oxide removal materials.

In some embodiments, the controller may be configured to control an actuator that may alternate polishing processes for one or more time intervals. For instance, the actuator may activate an oxidation process on the workpiece for a first process period and then activate an oxide removal process on the workpiece for a second process period. In some instances, there may be no time overlap between the first process period and the second process period. However, in some instances, the first process period and the second process period may be separated by a time interval.

In some examples, the oxidizing material and/or the oxide removal material may include an actuatable material that is activated by an external stimulus (e.g., the actuator). For instance, the actuatable material may include a material that is activated by one or more of an electrostatic actuator, electrochemical actuator, acoustic actuator, ultrasonic actuator, optical actuator, thermal actuator (e.g., heat source, laser, lamp), or plasma-based actuator (e.g., the actuator). For instance, in some embodiments, the material may be inert and not react with a surface of the polishing platen and/or the silicon carbide semiconductor wafer until the material is actuated by the actuator. In some embodiments, the material may be activated to react with the silicon carbide semiconductor wafer only when exposed (or not exposed) to the external stimulus from the actuator. In this way, the active properties of the additive may be controlled (e.g., pulsed) by controlling the actuator.

In some examples, the additive may be activated when it interacts with (e.g., mixes, contacts, etc.) other additives or components in the grinding system. For instance, the additive may interact with other additives already present on the semiconductor wafer and/or the polishing pad to activate properties of the additive.

In some instances, the actuator may control the delivery system of the polishing system and may instruct the delivery system to deliver one or more materials to the polishing pad. For example, the actuator may control the delivery system to deliver an oxidizing material to a surface of the platen during a first process period and to deliver an oxide removal material to the surface of the platen during the second process period. In some embodiments, the controller may control the delivery system to deliver an actuatable material to the platen. The actuator may then activate the actuatable material on the platen to provide oxidation to the platen during a first process period. Similarly, the actuator may also activate the actuatable material on the platen to provide oxide removal to the platen during a second process period.

Aspects of the present disclosure provide a number of technical effects and benefits. For instance, use of a polishing platen and/or polishing pads with multiple zones may reduce wear and consumable cost of the platens and/or polishing pads themselves. As previously mentioned, traditional methods of polishing may lead to platen contamination between polishing processes and therefore rapidly wear the polishing pads on the platen. Therefore, separating the platen and/or polishing pad into one or more zones with dedicated materials and processes for each allows for reduced or eliminated contamination between polishing processes thereby enhancing polishing pad lifespan.

Contamination between multiple polishing processes may reduce the effectiveness of each respective process thereby requiring longer process periods for each process to achieve the desired results. Keeping the materials of each polishing process separate eliminates contamination between polishing processes, improving the effectiveness of each process and thereby reducing the duration of process periods. Additional benefits from embodiments of the present disclosure may also include improved system stability due to reduced clogging and, therefore, reduced cleaning efforts required for wafer polishing systems.

Additionally, by keeping the materials of individual polishing processes separated into isolated zones, the efficiency of each process may be improved. For instance, separating the materials (e.g., oxide materials and oxide removal materials) into separate zones may allow for optimizing process conditions for each part of a polishing process separately, increasing the overall efficiency of the polishing process. For instance, by optimizing the oxidizing function in a first zone or a first time period, a slurry with the need to carry abrasive particles during an oxidizing process may no longer be needed. Thus, the issue of clogging through slurry instabilities may be solved. The oxide removal process in a second zone or a second time period may be free to use a process with abrasive particles tailored for oxide removal only that may not cause clogging or workpiece scratching through agglomerates.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

It will be understood that when an element such as a layer, structure, region, or substrate is referred to as being "on" or extending "onto" another element, it may be directly on or extend directly onto the other element or intervening elements may also be present and may be only partially on the other element. In contrast, when an element is referred to as being "directly on" or extending "directly onto" another element, there are no intervening elements present, and may be partially directly on the other element. It will also be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present.

As used herein, a first structure "at least partially overlaps" or is "overlapping" a second structure if an axis that is perpendicular to a major surface of the first structure passes through both the first structure and the second structure. A "peripheral portion" of a structure includes regions of a structure that are closer to a perimeter of a surface of the structure relative to a geometric center of the surface of the structure. A "center portion" of the structure includes regions of the structure that are closer to a geometric center of the surface of the structure relative to a perimeter of the surface. "Generally perpendicular" means within 15 degrees of perpendicular. "Generally parallel" means within 15 degrees of parallel.

Relative terms such as "below" or "above" or "upper" or "lower" or "horizontal" or "lateral" or "vertical" may be used herein to describe a relationship of one element, layer or region to another element, layer or region as illustrated in the figures. It will be understood that these terms are intended to encompass different orientations of the device in addition to the orientation depicted in the figures.

Embodiments of the disclosure are described herein with reference to cross-section illustrations that are schematic illustrations of idealized embodiments (and intermediate structures) of the invention. The thickness of layers and regions in the drawings may be exaggerated for clarity. Additionally, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Similarly, it will be understood that variations in the dimensions are to be expected based on standard deviations in manufacturing procedures. As used herein, "approximately" or "about" includes values within 10% of the nominal value.

Like numbers refer to like elements throughout. Thus, the same or similar numbers may be described with reference to other drawings even if they are neither mentioned nor described in the corresponding drawing. Also, elements that are not denoted by reference numbers may be described with reference to other drawings.

Some embodiments of the invention are described with reference to semiconductor layers and/or regions which are characterized as having a conductivity type such as n type or p type, which refers to the majority carrier concentration in the layer and/or region. Thus, n type material has a majority equilibrium concentration of negatively charged electrons, while p type material has a majority equilibrium concentration of positively charged holes. Some material may be designated with a "+" or "−" (as in n+, n−, p+, p−, n++, n−, p++, p−−, or the like), to indicate a relatively larger ("+") or smaller ("−") concentration of majority carriers compared to another layer or region. However, such notation does not imply the existence of a particular concentration of majority or minority carriers in a layer or region.

In the drawings and specification, there have been disclosed typical embodiments and, although specific terms are employed, they are used in a generic and descriptive sense only and not for purposes of limitation of the scope set forth in the following claims.

FIG. 1 depicts an example polishing system 100 for a silicon carbide semiconductor wafer 105 according to example embodiments of the present disclosure. The polishing system 100 is a CMP system operable to perform one or more polishing operations for a silicon carbide wafer 105. The silicon carbide wafer 105 may include 4H silicon carbide, 6H silicon carbide or other crystal structure. The silicon carbide wafer 105 may be doped or undoped. In some examples, the polishing system 100 includes a platen 110 with a polishing pad 120, a workpiece carrier 130, a delivery system 140, a conditioning head 150, and a controller 160.

More specifically, the polishing system 100 includes the platen 110. The platen 110 may be operable to rotate about an axis 104. The platen 110 may be operable to rotate about the axis 104 in either a clockwise or counterclockwise direction. In some examples, the platen 110 may rotate, for instance, at a rotational speed in a range of about 10 rpm to about 10000 rpm, such as about 10 rpm to about 7500 rpm, such as about 10 rpm to about 2000 rpm, such as about 10 rpm to about 1000 rpm, such as about 10 rpm to about 500 rpm, such as about 10 rpm to about 120 rpm.

The platen 110 may include a receptacle 112. The receptacle 112 may be configured to hold a polishing pad 120 for a CMP process. The receptacle 112 may be a surface configured to support or receive the polishing pad 120. In some examples, the receptacle 112 may be a planar surface that supports the polishing pad 120.

The polishing pad 120 may provide a surface for polishing the silicon carbide semiconductor wafer 105. The polishing pad 120 may include durable and chemically resistant materials such as polyurethane and/or polyether ether ketone (PEEK) material. The polishing pad 120 may have a surface with a specified roughness and porosity to facilitate polishing a silicon carbide semiconductor wafer 105. The polishing pad 120 may have one or more wear-resistant layers (e.g., diamond layers, diamond-like carbon layers, ceramic layers, etc.). The polishing pad 120 may include grooves or dimples to increase slurry distribution and reduce edge effects during the CMP process. The polishing pad 120 may include a cushioning layer (e.g., foam or rubber), in some examples, to facilitate adaptation of the polishing pad 120 to the topography of the semiconductor wafer 105, providing improved planarity of the semiconductor wafer 105.

The polishing pad 120 may have a diameter. The diameter may be greater than a size of the silicon carbide semiconductor wafer 105. The polishing pad 120 may have a diameter in a range of, for instance, about 150 mm to about 820 mm, such as in a range of about 150 mm to about 400 mm, such as in a range of about 150 mm to about 300 mm. In some examples, the diameter of the polishing pad 120 may be smaller or nearly the same size as the diameter of the platen 110 (FIG. 1). However, the diameter of the polishing pad 120 may be larger than the diameter of the platen 110 without deviating from the scope of the present disclosure. In some examples, the polishing pad 120 may have a thickness in a range of about 2 mm to about 40 mm, such as in a range of 5 mm to about 40 mm, such as in a range of about 10 mm to about 40 mm.

According to examples aspects of the present disclosure, the platen 110 and/or polishing pad 120 may additionally include a separator 115 operable to separate the polishing pad 120 into two or more zones or regions. As used herein, the terms "zone" and "region" on the polishing pad may be used interchangeably. In some examples, the polishing pad 120 may be separated into a first zone 122 and a second zone 124 by the separator 115. In some embodiments, two separate polishing pads are used, one for the first zone 122 and one for the second zone 124. In some examples, the same polishing pad 120 is divided into zones using a separator 115. FIG. 1 depicts two regions (e.g., first region 122 and second region 124) for purposes of illustration and discussion. Those of ordinary skill in the art, using the disclosures provided herein, will understand that more regions (e.g., three or more, such as four or more, such as five or more) may be included without deviating from the scope of the present disclosure.

Figure 2:
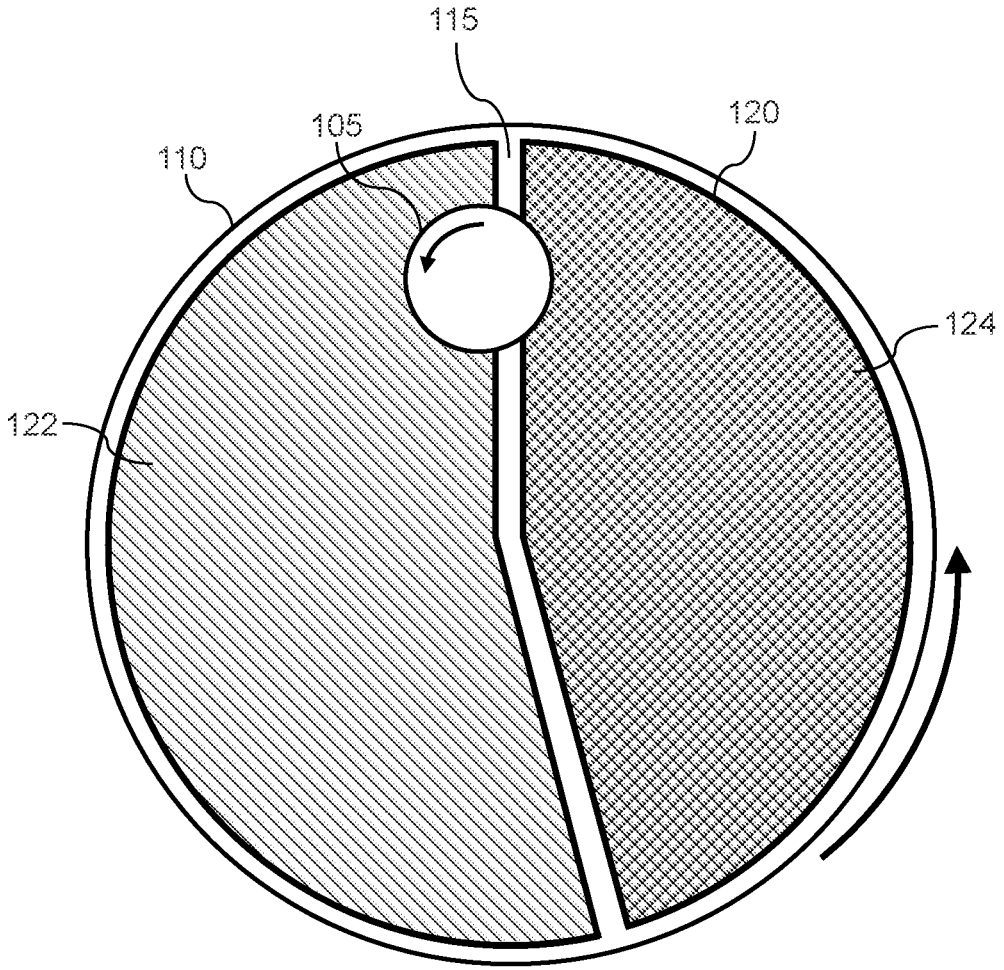
FIG. 2 depicts a top-down view of the platen, polishing pad, and semiconductor wafer on a polishing system according to example aspects of the present disclosure.

FIG. 2 depicts a plan view of the platen 110, polishing pad 120, and semiconductor wafer 105 on the polishing system 100 according to example aspects of the present disclosure. The platen 110 may include the separator 115 which may divide the polishing pad 120 into two or more zones. For example, the polishing pad 120 may be divided into a first zone 122 and a second zone 124. As depicted in FIG. 2, the separator 115 may pass through the center of the polishing pad 120, but it should be appreciated the separator may divide the platen 110 and/or polishing pad 120 into a variety of different quantity and size zones. For example, the separator may divide the platen 110 and/or polishing pad such that the first zone 122 is a different size relative to the second zone 124. However, other suitable divisions and/or additional zones may be used without deviating from the scope of the present disclosure.

The polishing pad 120 in the first zone 122 may have the same or a different material configuration relative to the polishing pad 120 in the second zone 124. For instance, in some examples, the second zone 124 of the polishing pad 120 may include more abrasive containing materials relative to the first zone 122, or vice versa. In some examples, the first zone 122 may include a material (e.g., an additive) associated with a first process. The second zone 124 may include a material (e.g., an additive) associated with a second process.

For instance, in some examples, the first zone 122 may include one or more oxidizing materials embedded in or provided on the first zone 122. The oxidizing material may be provided as a liquid or power on the first zone 122. In some examples, the oxidizing material may include, for instance, one or more of hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate. In some examples, the oxidizing material may include an organic peroxide, such as one or more of benzoyl peroxide or dimethyl peroxide. In some examples, the oxidizing material includes hydrogen peroxide that may or may not be exposed to one or more $Fe^{+2}$ compounds. In some examples, the oxidizing material (e.g., hydrogen peroxide) may include additional chemical elements to improve their oxidizing properties, such as $NaHCO_3$ and/or $KHCO_3$.

In some embodiments, the second zone 124 may include one or more oxide removal materials embedded in or provided on the second zone 124. For instance, the polishing pad may include an abrasive surface. The abrasive surface may include an abrasive containing material. The abrasive containing material may be suitable for grinding silicon carbide. The abrasive containing material may include a plurality of abrasive elements (e.g., abrasive particles) in a host material or matrix. In some examples, the host material may include one or more vitreous material, metal, resin, and/or other sintered material and/or organic material. In some embodiments, the abrasive elements may be diamond or a diamond coated material. In some embodiments, the abrasive elements may include a ceramic material. Example ceramic materials may include, for instance, boron carbide ($B_4C$) and cubic boron nitride (BN). In some examples, the abrasive elements may include one or more metal oxides (sintered and/or unsintered). In some embodiments, the abrasive elements may include silica, ceria, zirconia, alumina, silicon carbide, nitrates, and/or other carbides and in general one or more of: (i) diamond; (ii) ceramic; (iii) metal nitride; (iv) metal oxide, (v) metal carbide; (vi) metalloid nitride; (vii) metalloid oxide; (viii) metalloid carbide; (ix) carbon group nitride; (x) carbon group oxide; or (xi) carbon group carbide.

The second zone 124 may include one or more additives for oxide removal, such as one or more etchants, such as acid-based etchants (with or without a buffer), such as fluorine containing etchants (e.g., hydrofluoric acid, fluoroantimonic acid, ammonium bifluoride), caustic compounds (e.g., sodium hydroxide and/or potassium hydroxide), or other etchants.

Figure 3:
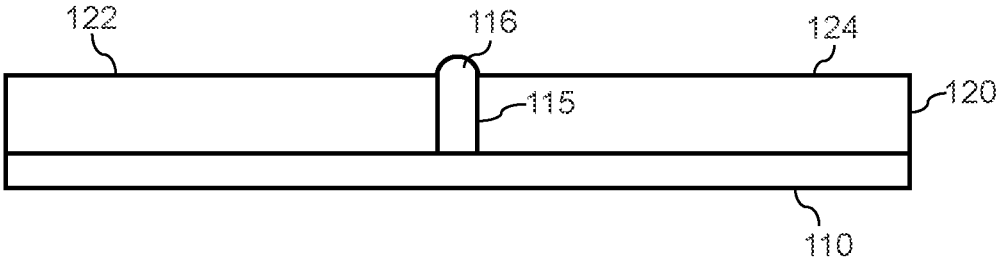
FIG. 3 depicts a cross-sectional view of an example polishing pad with a separator according to example embodiments of the present disclosure.

FIG. 3 depicts a cross-sectional view of a polishing pad 120 with a separator 115 according to example embodiments of the present disclosure. In the example of FIG. 3, the separator 115 includes a lip 116 that extends and/or protrudes from the platen 110 and/or the polishing pad 120. The lip 116 may be made from a variety of materials, for example, polymer, silicone, rubber, and/or plastic. The lip 116 may separate the polishing pad 120 into the first zone 122 and the second zone 124.

Figure 4:
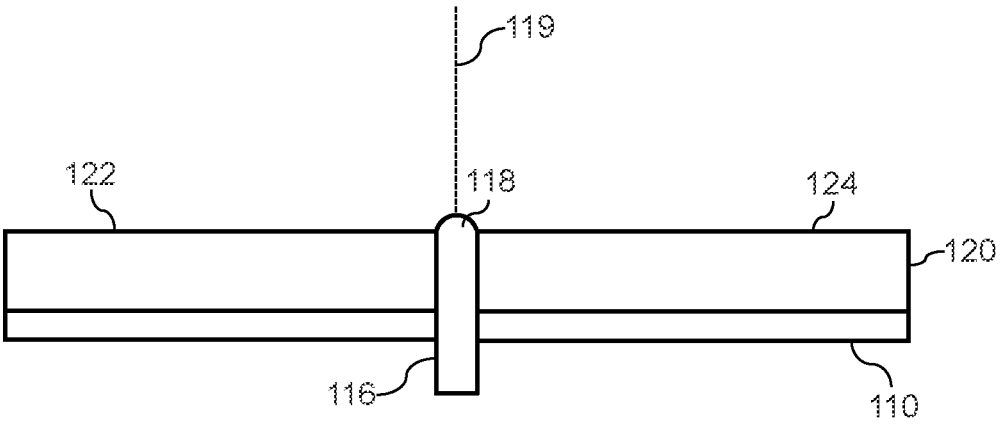
FIG. 4 depicts a cross-sectional view of an example polishing pad with a separator according to example embodiments of the present disclosure.

FIG. 4 depicts a cross-sectional view of a polishing pad 120 with a separator 115 according to example embodiments of the present disclosure. In the example of FIG. 4, the separator 115 includes a fluid blade 118 (e.g., an air blade) operable to provide a separator fluid 119 to separate the first region 122 from the second region 124. The separator fluid 119 may be, for example, air, water, liquid, or a gas, or other fluid. The separator fluid 119 may separate the polishing pad 120 into the first zone 122 and the second zone 124. In some examples, the separator fluid 119 is a neutralizing substance that may be used, for instance, to reduce undesirable reactions.

Referring back to FIG. 1, the first zone 122 may be associated with a first process and the second zone 124 may be associated with a second process. The second process may be different from the first process. For instance, when the semiconductor wafer 105 is provided against the first zone 122, the semiconductor wafer 105 may be subjected to a first process (e.g., an oxidation process). When the semiconductor wafer 105 is provided against the second zone 124, the semiconductor wafer 105 may be subjected to a second process (e.g., an oxide removal process). In this way, the first process may be implemented in a spatially separated manner relative to the second process.

As an example, the first process may be an oxidation process. The second process may be an oxide removal process. The first zone 122 may be associated with exposing the semiconductor wafer 105 to an oxidizing material (e.g., with or without a slurry). The second zone 124 may be associated with an oxide removal process. The second zone may be associated with exposing the semiconductor wafer 105 to an oxide removal material (e.g., with or without a slurry), such as one or more abrasive elements.

In some examples, the polishing system 100 includes a delivery system 140. The delivery system 140 may be used to deliver a slurry to the polishing pad 120 held on the platen 110 during a CMP process, for instance, from a slurry delivery outlet 142. In some examples, the slurry may be, for instance, a permanganate-based slurry, such as potassium permanganate-based slurry. Other suitable slurries with one or more abrasive elements (e.g., abrasive particles) may be used without deviating from the scope of the present disclosure. The delivery system 140 may further include one or more fluid delivery outlets 144. The fluid delivery outlets 144 may be configured to provide one or more fluids (e.g., coolant, additive, lubricant, etc.) to the polishing pad 120 during a polishing process. In some examples, the delivery system 140 may include an additive delivery system 145 configured to deliver one or more additives 125 (e.g., oxidizing material, oxide removal material) either with the slurry through the slurry delivery outlet 142 or separate from the slurry through the fluid delivery outlet 144.

Aspects of the present disclosure are discussed with reference to providing the oxidizing materials and oxide removal materials to the polishing pad 120 through fluid delivery outlets 144 for purposes of illustration and discussion. Those of ordinary skill in the art, using the disclosures provided herein, will understand that the delivery system 140 may deliver materials (e.g., slurry, oxidizing materials, oxide removal materials) to the polishing pad 120 in various ways without deviating from the scope of the present disclosure, such as from a plurality of fluid delivery outlets, from apertures in the platen and/or the polishing pad, or from other fluid delivery techniques.

In some examples, the polishing system 100 includes a workpiece carrier 130. The workpiece carrier 130 is operable to bring one or more silicon carbide semiconductor wafers 105 into contact with the polishing pad 120 to implement a polishing process. In some examples, the workpiece carrier 130 may be operable to hold a single silicon carbide semiconductor wafer 105 for single wafer processing. In some examples, the workpiece carrier 130 may be operable to hold a plurality of silicon carbide semiconductor wafers 105 for batch processing.

The workpiece carrier 130 may be operable to rotate the silicon carbide semiconductor wafer 105 about an axis 132. The axis 132 is not aligned with the axis 104 associated with the platen 110. The workpiece carrier 130 may be operable to rotate the silicon carbide semiconductor wafer 105 about the axis 132 in either a clockwise or counterclockwise direction. In some examples, the workpiece carrier 130 may rotate, for instance, at a rotational speed in range of about 10 rpm to about 10000 rpm, such as about 10 rpm to about 7500 rpm, such as about 10 rpm to about 2000 rpm, such as about 10 rpm to about 1000 rpm, such as about 10 rpm to about 500 rpm, such as about 10 rpm to about 120 rpm. The workpiece carrier 130 may rotate in the same direction as the platen 110 or in a different direction relative to the platen 110.

The workpiece carrier 130 may be able to provide a downforce 134 of the silicon carbide semiconductor wafer 105 against the polishing pad 120. The downforce 134 of the workpiece carrier 130 may be controlled to adjust the polishing rate of the polishing process of the silicon carbide semiconductor wafer 105.

The workpiece carrier 130 may also oscillate in a lateral direction along the surface of the polishing pad 120. This will allow exposure of the semiconductor wafer 105 to different portions of the polishing pad 120 (e.g., at different radii of the polishing pad 120) during a polishing operation.

The polishing system 100 may include a conditioning head 150. The conditioning head 150 may rotate about an axis 152, such that the conditioning head 150 rotates along the surface of the polishing pad 120 (e.g., in either a clockwise or counterclockwise direction). In some examples, the conditioning head 150 may be on a swing arm 154 that may swing about an axis 156 to move the conditioning head 150 to different locations on the polishing pad 120. The conditioning head 150 may include an abrasive-containing material that is used to condition or dress the polishing pad 120 as the polishing pad 120 is subject to glazing during a polishing process.

The system 100 includes one or more control devices, such as a controller 160. The controller 160 may include one or more processors 162 and one or more memory devices 164. The one or more memory devices 164 may store computer-readable instructions that when executed by the one or more processors 162 cause the one or more processors 162 to perform one or more control functions, such as any of the functions described herein. The controller 160 may be in communication with various other aspects of the system 100 through one or more wired and/or wireless control links. For instance, the controller 160 may control the platen 110, the workpiece carrier 130, the delivery system 140, and/or the conditioning head 150 to implement polishing processes according to examples of the present disclosure.

For instance, in some examples, the controller 160 may control the delivery system 140 to deliver a first material to the first zone 122 of the polishing pad 120 and to deliver a second material to the second zone 124 of the polishing pad 120. For instance, the controller 160 may control the delivery system 140 to provide an oxidizing material to the first zone of the polishing pad 120 (e.g., through one or more of slurry delivery outlet 142 and/or fluid delivery outlet 144) and to provide an oxide removal material to the second zone 124 of the polishing pad 120 (e.g., through one or more of slurry delivery outlet 142 and/or fluid delivery outlet 144).

For instance, in some examples, the controller 160 may be operable to control the delivery system 140 based at least in part on a position of the first zone 122 and the second zone 124 (e.g., based on a rotational position of the polishing pad 120). For instance, in some examples, the controller 160 may control the delivery system 140 to provide oxidizing materials to the first zone 122 of the polishing pad 120 when the polishing pad 120 passes under a delivery outlet (e.g., slurry delivery outlet 142 and/or fluid delivery outlet 144) associated with delivery of the oxidizing materials. The controller 160 may control the delivery system 140 to provide oxide removal materials to the second zone 124 of the polishing pad 120 when the polishing pad 120 passes under a delivery outlet (e.g., slurry delivery outlet 142 and/or fluid delivery outlet 144) associated with delivery of oxide removal materials. In this way, the controller 160 may control the delivery system 140 to provide the oxide removal materials in a spatially separated manner relative to providing the oxidizing materials to the polishing pad 120.

In some examples, the controller 160 may control the delivery system 140 to provide a first material (e.g., oxidizing material) to the polishing pad 120 and a second material (e.g., oxide removal material) in a time-separated manner. For instance, the controller 160 may control the delivery system 140 as an actuator to provide a first material (e.g., oxidizing material) to a surface of the polishing pad 120 during the first process period and to provide an oxide removal material to the surface of the polishing pad 120 during the second process period. There may be no time overlap between the first process period and the second process period. For instance, the first process period may be separated from the second process period by a time interval.

As shown in FIG. 1, in some examples, the system 100 may include an actuator 170. The actuator 170 may be, for instance, one or more of an electrostatic actuator, electrochemical actuator, acoustic actuator, ultrasonic actuator, optical actuator, thermal actuator (e.g., heat source, laser, lamp), or plasma-based actuator. The actuator 170 may be configured to provide an external stimulus to an actuatable material on the polishing pad 120 to activate properties of the actuatable material. The actuatable material may be provided to the polishing pad 120 through, for instance, the delivery system 140 or through other suitable techniques, such as through apertures in the polishing pad 120. In some examples, the actuatable material is embedded in or otherwise on the polishing pad 120.

In some examples, the actuatable material may act as an oxidizing material based on the external stimulus from the actuator 170. In some examples, the actuatable material may act as an oxide removel material based on the external stimulus from the actuator 170. For instance, the actuatable material may include a material that is activated by the actuator 170. For instance, in some embodiments, the material may be inert and not react with a surface of the silicon carbide semiconductor wafer until the material is actuated by the actuator 170. In some embodiments, the material may be activated to react with the silicon carbide semiconductor wafer only when exposed (or not exposed) to the external stimulus from the actuator 170. In this way, the active properties of the actuatable material may be controlled (e.g., pulsed) by controlling the actuator 170. For instance, the controller 160 may control the actuator 170 to activate the actuatable material in a pulsed manner to provide a time separation between a first process and a second process on the semiconductor wafer 105.

As one example, the controller 160 may be configured to control the actuator 170 to activate oxidation properties of the actuatable material to provide oxidation during a first process period. The actuator 170 may be controlled not to activate oxidation in the actuatable material during a second process period during which oxide removal may occur using an oxide removal material. As another example, the controller 160 may be configured to control the actuator 170 to activate oxide removal properties of the actuatable material to provide oxide removal during a first process period. The actuator 170 may be controlled not to activate oxide removal during the second process period during which oxidation may occur using an oxidizing material.

In some examples, the controller 160 may be configured to control the actuator 170 to activate a first actuatable material to act as an oxidizing material during a first process period. The controller 160 may be configured to control the actuator 170 to activate a second actuatable material to act as an oxide removal material during a second process period. In this way, the controller 160 may be configured to pulse or otherwise control the actuator 170 to provide oxidation and oxide removal in a time separated manner.

In some examples, for instance, an ultraviolet actuator may provide UV light stimulus to provide photochemical activation and/or photocatalytic effects in an actuatable material, such as hydrogen peroxide and/or organic peroxide to generate, for instance, hydroxyl radicals for oxidation of the semiconductor wafer.

Figure 5:
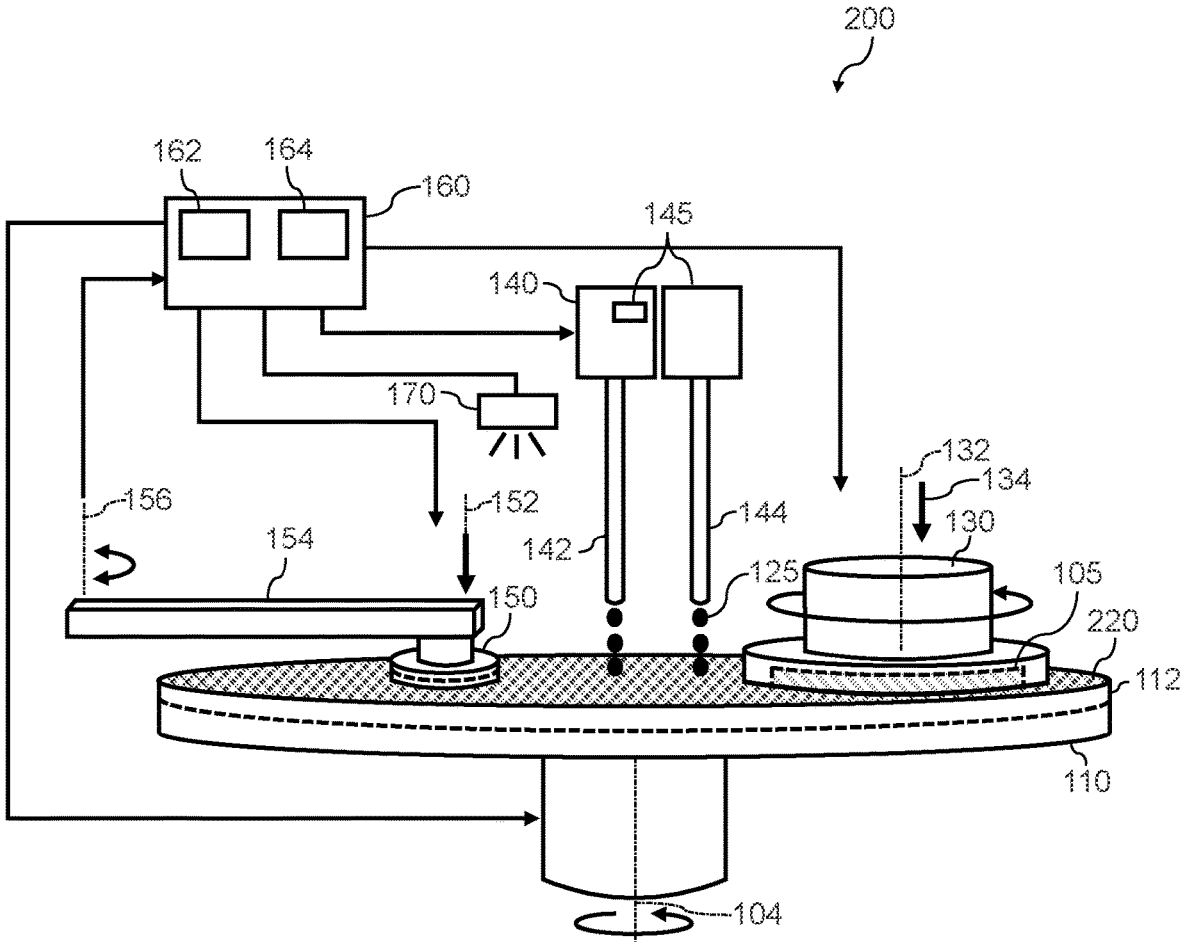
FIG. 5 depicts an example polishing system for a semiconductor workpiece according to example embodiments of the present disclosure.

FIG. 5 depicts a polishing system 200 according to example embodiments of the present disclosure. The polishing system 200 is similar to the polishing system 100 of FIG. 1. However, the polishing system 200 does not include a polishing pad with spatial separation of a first zone 122 and a second zone 124 as described with reference to FIG. 1. Rather, the polishing pad 220 of FIG. 5 has a polishing pad with a single zone with no separator.

The polishing system 200 may include a controller 160 operable to control the fluid delivery system 140 and/or the actuator 170 to provide a first process and a second process in a time separated manner (but not necessarily in a spatially separated manner). For instance, in some examples, the controller 160 may control the delivery system 140 to provide a first material (e.g., oxidizing material) to the polishing pad 220 and a second material (e.g., oxide removal material) in a time-separated manner. For instance, the controller 160 may control the delivery system 140 as an actuator to provide a first material (e.g., oxidizing material) to a surface of the polishing pad 220 during the first process period and to provide an oxide removal material to the surface of the polishing pad 220 during the second process period. There may be no time overlap between the first process period and the second process period. For instance, the first process period may be separated from the second process period by a time interval.

The system 200 may include an actuator 170. The actuator 170 may be, for instance, one or more of an electrostatic actuator, electrochemical actuator, acoustic actuator, ultrasonic actuator, optical actuator, thermal actuator (e.g., heat source, laser, lamp), or plasma-based actuator. The actuator 170 may be configured to provide an external stimulus to an actuatable material on the polishing pad 220 to activate properties of the actuatable material. The actuatable material may be provided to the polishing pad 220 through, for instance, the delivery system 140 or through other suitable techniques, such as through apertures in the polishing pad 220. In some examples, the actuatable material is embedded in or otherwise on the polishing pad 220.

In some examples, the actuatable material may act as an oxidizing material based on the external stimulus from the actuator 170. In some examples, the actuatable material may act as an oxide removal material based on the external stimulus from the actuator 170.

For instance, in some examples, the material may be inert and not react with a surface of the silicon carbide semiconductor wafer until the material is actuated by the actuator 170. In some embodiments, the material may be activated to react with the silicon carbide semiconductor wafer only when exposed (or not exposed) to the external stimulus from the actuator 170. In this way, the active properties of the actuatable material may be controlled (e.g., pulsed) by controlling the actuator 170. For instance, the controller 160 may control the actuator 170 to activate the actuatable material in a pulsed manner to provide a time separation between a first process and a second process on the semiconductor wafer 105.

As one example, the controller 160 may be configured to control the actuator 170 to activate oxidation properties of the actuatable material to provide oxidation during a first process period. The actuator 170 may be controlled not to activate oxidation in the actuatable material during a second process period during which oxide removal may occur using an oxide removal material. As another example, the controller 160 may be configured to control the actuator 170 to activate oxide removable properties of the actuatable material to provide oxide removal during a first process period. The actuator 170 may be controlled not to activate oxide removal during the second process period during which oxidation may occur using an oxidizing material.

In some examples, the controller 160 may be configured to control the actuator 170 to activate a first actuatable material to act as an oxidizing material during a first process period. The controller 160 may be configured to control the actuator 170 to activate a second actuatable material to act as an oxide removal material during a second process period. In this way, the controller 160 may be configured to pulse or otherwise control the actuator 170 to provide oxidation and oxide removal in a time separated manner. There may be no time overlap between the first process period and the second process period. For instance, the first process period may be separated from the second process period by a time interval.

In some examples, the first process (e.g., oxidation process) and the second process (e.g., oxide removal process) may be spatially separated and/or time separated by implementing the first process and the second process using different polishing pads, different polishing systems and/or different process platforms. For instance, the first process may be performed on a first polishing pad and a second process may be performed on a second polishing pad. As another example, the first process may be performed on a polishing pad and the second process may be performed in a separate process platform (e.g., that is not a polishing system). As another example, the first process may be performed in a separate process platform (e.g., that is not a polishing system) and the second process may be performed on a polishing pad.

Figure 6A:
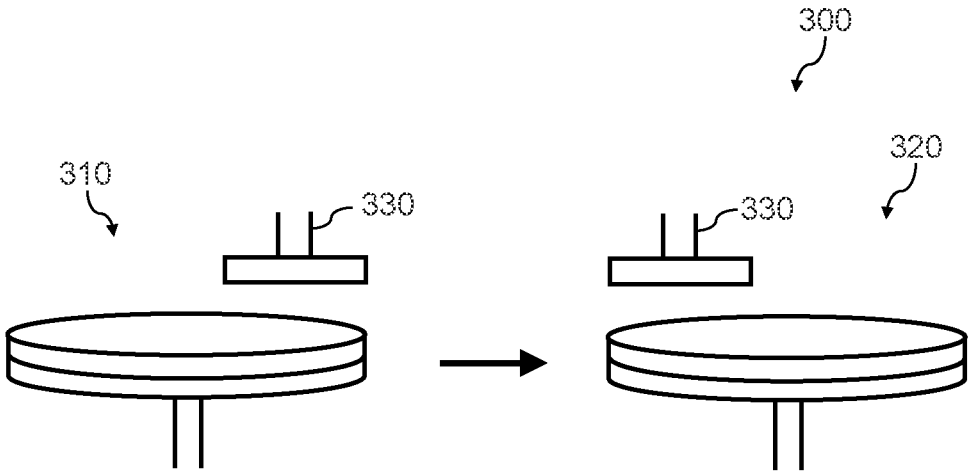
FIGS. 6A, 6B, and 6C depict example polishing systems for a semiconductor workpiece according to example embodiments of the present disclosure.

For instance, FIG. 6A depicts an example polishing system 300 according to examples of the present disclosure. As illustrated, the system 300 includes a first polishing pad system 310 and a second polishing pad system 320. The first polishing pad system 310 may be used to implement a first process (e.g., oxidation process) for a first process period. The second polishing pad system 320 may be used to implement a second process (e.g., oxide removal process) for a second process period.

The first polishing pad system 310 may include one or more components similar to the system 200 illustrated in FIG. 5, such as a platen, polishing pad, workpiece carrier, delivery system, controller, actuator, etc. The first polishing pad system 310 may be configured to implement, for instance, an oxidation process as described with reference to FIGS. 1 and 5.

The second polishing pad system 320 may include one or more components similar to the system 200 illustrated in FIG. 5, such as a platen, polishing pad, workpiece carrier, delivery system, controller, actuator, etc. The second polishing pad system 320 may be configured to implement, for instance, an oxide removal process as described with reference to FIGS. 1 and 5.

In some examples, the first polishing pad system 310 and the second polishing pad system 320 may share some common components. For instance, in some examples, a common workpiece carrier 330 may provide a semiconductor wafer against a polishing pad of the first polishing pad system 310 for a first process period and provide the semiconductor wafer against a polishing pad of the second polishing pad system 320 for a second process period. However, in other embodiments, each of the first polishing pad system 310 and the second polishing pad system 320 may have a separate workpiece carrier. In some examples, a common controller may control aspects of the first polishing pad system 310 and the second polishing pad system 320.

Figure 6B:
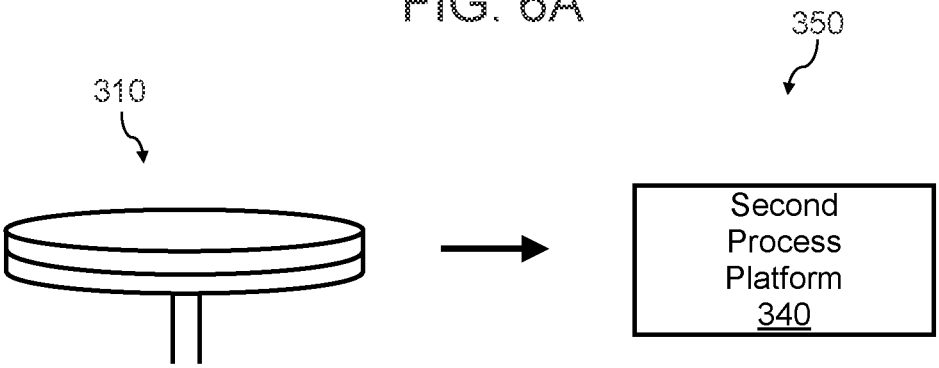

FIG. 6B depicts an example polishing system 350 according to example embodiments of the present disclosure. As illustrated, the system 350 includes a first polishing pad system 310 and a second process platform 340. The first polishing pad system 310 may be used to implement a first process (e.g., oxidation process) for a first process period. The second process platform 340 may be used to implement a second process (e.g., oxide removal process) for a second process period.

The first polishing pad system 310 may include one or more components similar to the system 200 illustrated in FIG. 5, such as a platen, polishing pad, workpiece carrier, delivery system, controller, actuator, etc. The first polishing pad system 310 may be configured to implement, for instance, an oxidation process as described with reference to FIGS. 1 and 5. The first polishing pad system 310 may include a polishing pad, for instance, configured to perform the first process, such as an oxidation process. The delivery system for the first polishing pad system 320 may be operable to deliver an oxidizing material.

The second process platform 340 may be a different type of tool used to implement the second process (e.g., oxide removal process). For instance, the second process platform may include one or more of an etchant bath, wet etch system, dry etch system, or other system that may be used to implement the second process (e.g., oxide removal process). Those of ordinary skill in the art, using the disclosures provided herein, will understand that a variety of different process platforms may be used to implement the second process (e.g., oxide removal process) without deviating from the scope of the present disclosure.

Figure 6C:
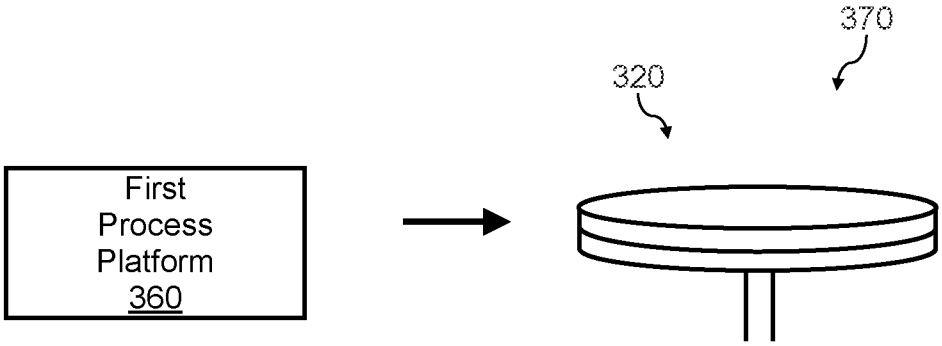

FIG. 6C depicts an example polishing system 370 according to example embodiments of the present disclosure. As illustrated, the system 370 includes a first process platform 360 and a second polishing pad system 320. The first process platform 360 may be used to implement a first process (e.g., oxidation process) for a first process period. The second polishing pad system 320 may be used to implement a second process (e.g., oxide removal process) for a second process period.

The second polishing pad system 320 may include one or more components similar to the system 200 illustrated in FIG. 5, such as a platen, polishing pad, workpiece carrier, delivery system, controller, actuator, etc. The second polishing pad system 320 may include a polishing pad, for instance, configured to perform the second process, such as an oxide removal process. The delivery system for the second polishing pad system 320 may be operable to deliver an oxide removal material.

The first process platform 360 may be a different type of tool relative to the second polishing pad system 320. The first process platform 360 may be configured to implement the first process (e.g., oxidation process). For instance, the first process platform may include one or more baths, deposition systems, oxidation systems, etc. configured to implement the first process. Those of ordinary skill in the art, using the disclosures provided herein, will understand that a variety of different process platforms may be used to implement the first process (e.g., oxidation process) without deviating from the scope of the present disclosure.

Figure 7:
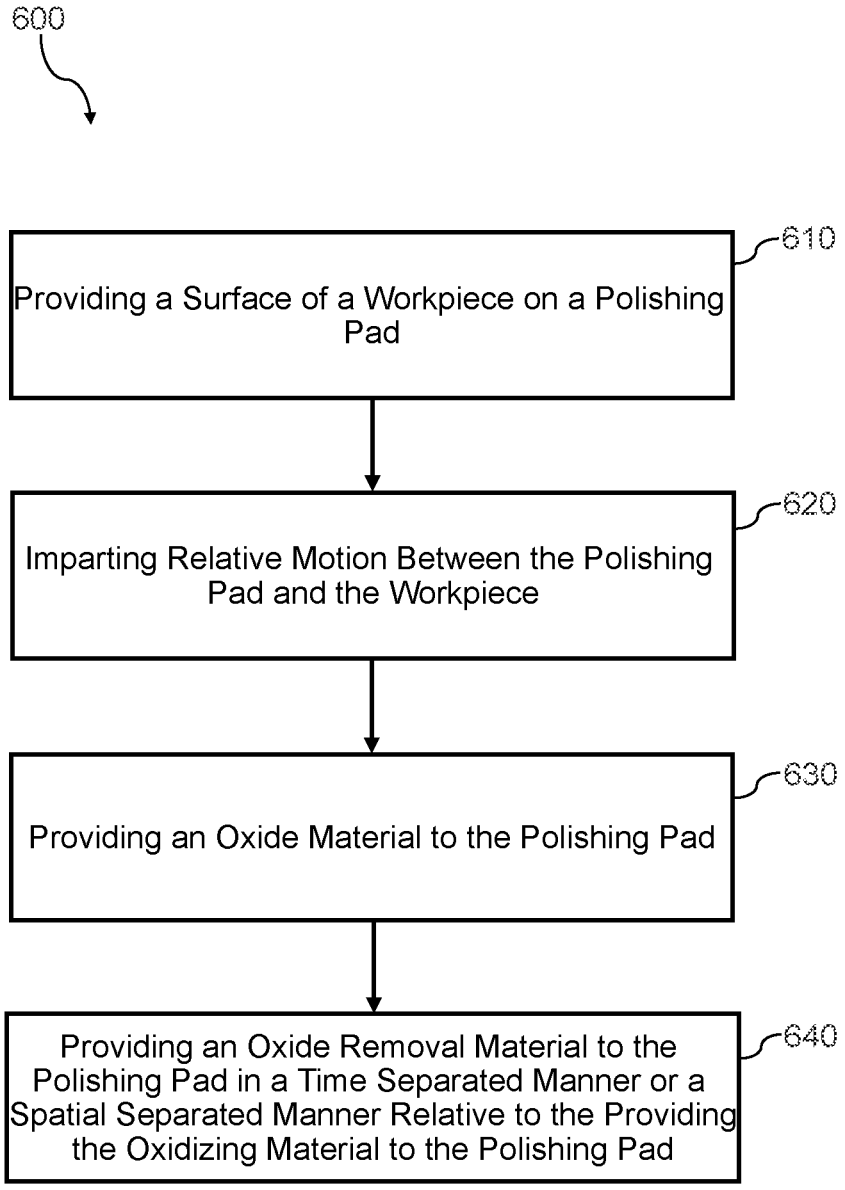
FIG. 7 depicts a flow chart of an example method according to example embodiments of the present disclosure.

FIG. 7 depicts a flow chart of an example method 600 according to example embodiments of the present disclosure. The method 600 may be implemented, for instance, using the polishing system 100 of FIG. 1. The method 600 depicts operations performed in a particular order for purposes of illustration and discussion. Those of ordinary skill in the art, using the disclosures provided herein, will understand that the operations of any of the methods described herein may be adapted, expanded, performed simultaneously, omitted, rearranged, include steps not illustrated, and/or modified in various ways without deviating from the scope of the present disclosure.

At 610, the method 600 may include providing a surface of a workpiece on a polishing pad. For instance, a workpiece may be on a workpiece support and the workpiece may be operable to provide a surface of the workpiece to the polishing pad. In some embodiments, the polishing pad may be on a platen of a chemical mechanical polishing (CMP) system.

At 620, the method 600 may include imparting relative motion between the platen and the workpiece. For instance, the platen may be rotated about a first axis causing relative motion between the polishing pad and the workpiece. In some embodiments, the workpiece may be rotated about a second axis imparting relative motion between the polishing pad and the workpiece. In some examples, the second axis may be different from the first axis.

At 630, the method 600 may include providing an oxidizing material to the polishing pad. Additionally, at 640, the method 600 may include providing an oxide removal material to the polishing pad in a time separated manner or a spatially separated manner relative to providing the oxidizing material to the platen.

In some embodiments, providing the oxidizing material and the oxide removal material in a spatially separated manner includes providing the oxidizing material and oxide removal material to separate the first and second zones on the platen. The first and second zones may be separated on the polishing pad by a separator such as, for example, a fluid blade or polymer lip. The separator may pass through the center of the polishing pad, and, in some instances, the separator may create a first zone that is a different size relative to the second zone. In examples including a fluid blade, the fluid blade may be operable to inject a separator fluid such as, for example, air, water, liquid, or gas, to separate the first zone from the second zone. In some embodiments, the separator may include a lip that protrudes from the platen and/or the polishing pad. The lip may comprise, for example, polymer, silicon, rubber, or plastic.

In some embodiments, the oxidizing material and the oxide removal material are provided in a time-separated manner. For instance, the oxidizing material may be provided to the polishing pad for a first process period, and the oxide removal material may be provided to the platen for a second process period. In some instances, there may be no time overlap between the first process period and the second process period. In some embodiments, the first process period and the second process period may be separated by a time interval.

In some examples, the oxidizing material may include, for instance, one or more of hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate. In some examples, the oxidizing material may include an organic peroxide, such as one or more of benzoyl peroxide or dimethyl peroxide. In some examples, the oxidizing material includes hydrogen peroxide that may or may not be exposed to one or more $Fe^{+2}$ compounds. In some examples, the oxidizing material (e.g., hydrogen peroxide) may include additional chemical elements to improve their oxidizing properties, such as $NaHCO_3$ and/or $KHCO_3$.

In some examples, the oxide removal material may include one or more abrasive elements (e.g., abrasive particles), for instance, provided as part of a slurry. In some examples, the oxide removal material may include one or more etchants for etching an oxide, such as acid-based etchants (with or without a buffer), such as fluorine containing etchants (e.g., hydrofluoric acid, fluoroantimonic acid, ammonium bifluoride), caustic compounds (e.g., sodium hydroxide and/or potassium hydroxide), or other etchants.

The oxidizing material and the oxide removal material may be provided on the polishing pad in a variety of ways without deviating from the scope of the present disclosure. For instance, in some embodiments, the oxidizing material and/or the oxide removal material may be provided via a fluid through one or more apertures through the polishing pad. Additionally, or alternatively, the oxidizing material and/or the oxide removal material may be provided via a fluid through a fluid delivery outlet. Additionally, or alternatively, the oxidizing material and/or the oxide removal material may be embedded as part of the polishing pad.

Figure 8:
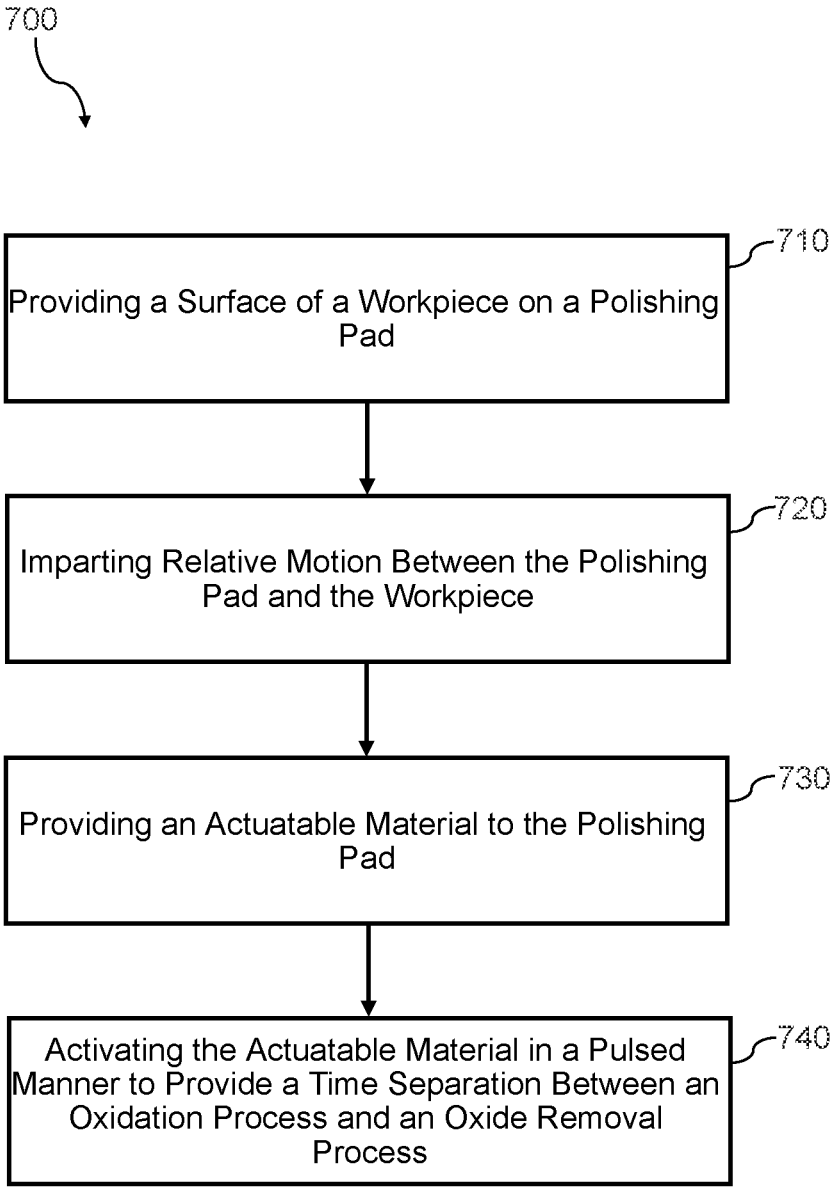
FIG. 8 depicts a flow chart of an example method according to example embodiments of the present disclosure.

FIG. 8 depicts a flow chart of an example method 700 according to example embodiments of the present disclosure. The method 700 may be implemented, for instance, using the polishing system 100 of FIG. 1 or the polishing system 200 of FIG. 5. The method 700 depicts operations performed in a particular order for purposes of illustration and discussion. Those of ordinary skill in the art, using the disclosures provided herein, will understand that the operations of any of the methods described herein may be adapted, expanded, performed simultaneously, omitted, rearranged, include steps not illustrated, and/or modified in various ways without deviating from the scope of the present disclosure.

At 710, the method 700 may include providing a surface of a workpiece on a polishing pad. For instance, a workpiece may be provided on a carrier and the workpiece carrier may be operable to provide a surface of the workpiece to the platen. In some instances, the platen may be a part of a chemical mechanical polishing (CMP) system.

At 720, the method 700 may include imparting relative motion between the platen and the workpiece. For instance, the polishing pad may be rotated about a first axis. The workpiece may be rotated about a second axis. In some examples, the second axis may be different and not aligned with the first axis.

At 730, the method 700 may include providing an actuatable material to the polishing pad. The actuatable material may be provided on the polishing pad in a variety of ways without deviating from the scope of the present disclosure. For instance, in some embodiments, the actuatable material may be provided via a fluid through one or more apertures through the polishing pad. Additionally, or alternatively, the actuatable material may be provided via a fluid through a fluid delivery outlet. Additionally, or alternatively, the actuatable material may be embedded as part of the polishing pad.

At 740, the method 700 may include activating the actuatable material in a pulsed manner to provide a time separation between an oxidation process and an oxide removal process. More particularly, the actuatable material may be activated by an external stimulus from an actuator. For instance, the actuatable material may be activated by one or more of an electrostatic actuator, electrochemical actuator, acoustic actuator, ultrasonic actuator, optical actuator, thermal actuator (e.g., heat source, laser, lamp), or plasma-based actuator (e.g., the actuator).

For instance, in some embodiments, the actuatable material may be inert and not react with a surface of the polishing platen and/or the silicon carbide semiconductor wafer until the material is actuated by the actuator. In some embodiments, the material may be activated to react with the surface of the silicon carbide semiconductor wafer only when exposed (or not exposed) to the external stimulus from the actuator. In this way, the active properties of the additive may be controlled (e.g., pulsed) by controlling the actuator.

For instance, the actuator may be pulsed to selectively activate the actuatable material and, for example, provide the oxidation process on the workpiece. Additionally, or alternatively, the actuator may be pulsed to selectively activate the actuatable material to provide the oxide removal process on the workpiece. The actuator may include a variety of components. As examples, the actuator may include one or more of an electrostatic actuator, electrochemical actuator, acoustic actuator, ultrasonic actuator, optical actuator, thermal actuator (e.g., heat source, laser, lamp), or plasma-based actuator.

One example aspect of the present disclosure is directed to a polishing system for a semiconductor workpiece. The polishing system includes a platen operable to rotate about an axis. The polishing system further includes a polishing pad on the platen. The polishing system further includes a workpiece carrier operable to bring a semiconductor workpiece into contact with the polishing pad. The polishing pad comprises a first zone and a second zone.

In some examples, the first zone and the second zone are separated by a separator.

In some examples, the separator comprises a fluid blade operable to inject a separator fluid to separate the first zone from the second zone.

In some examples, the separator fluid comprises air, water, liquid, or a gas.

In some examples, the separator comprises a lip that protrudes from the polishing pad.

In some examples, the lip comprises a polymer.

In some examples, the separator passes through a center of the polishing pad.

In some examples, the first zone is a different size relative to the second zone.

In some examples, the grinding system for a semiconductor workpiece may further include a delivery system operable to deliver an oxidizing material to the first zone and an oxide removal material to the second zone.

In some examples, the oxidizing material comprises hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate.

In some examples, the oxide removal material comprises one or more abrasive elements provided as part of a slurry.

In some examples, the polishing system comprises a controller operable to control the delivery system based at least in part on a position of the first zone and the second zone.

In some examples, the first zone comprises an oxidizing material on the polishing pad in the first zone.

In some examples, the second zone comprises one or more abrasive elements, wherein the one or more abrasive elements comprise one or more of: (i) diamond; (ii) ceramic; (iii) metal nitride; (iv) metal oxide, (v) metal carbide; (vi) metalloid nitride; (vii) metalloid oxide; (viii) metalloid carbide; (ix) carbon group nitride; (x) carbon group oxide; or (xi) carbon group carbide.

In some examples, the delivery system comprises one or more fluid delivery outlets operable to deliver a fluid to a surface of the polishing pad.

In some examples, the workpiece carrier is operable to rotate the semiconductor workpiece about a second axis.

In some examples, the polishing system comprises a chemical mechanical polishing (CMP) system.

Another example aspect of the present disclosure is directed to a polishing system for a semiconductor workpiece. The polishing system includes a platen operable to rotate about an axis. The polishing system further includes a polishing pad on the platen. The polishing system further includes a workpiece carrier operable to bring a semiconductor workpiece into contact with the polishing pad. The polishing system further includes a controller configured to control an actuator to perform operations. The operations include activating an oxidation process on the semiconductor workpiece for a first process period. The operations further include activating an oxide removal process on the semiconductor workpiece for a second process period.

In some examples, there is no time overlap between the first process period and the second process period.

In some examples, the first process period and the second process period are separated by a time interval.

In some examples, the actuator comprises a delivery system, wherein the controller is configured to control the delivery system to provide an oxidizing material to a surface of the polishing pad during the first process period and to provide an oxide removal material to the surface of the polishing pad during the second process period.

In some examples, the oxidizing material comprises hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate.

In some examples, the oxide removal material comprises one or more of abrasive elements provided as part of a slurry.

In some examples, the polishing system comprises a delivery system operable to deliver an actuatable material to the polishing pad.

In some examples, the controller is configured to control the actuator to activate the actuatable material to provide oxidation during the first process period.

In some examples, the controller is configured to control the actuator to activate the actuatable material to provide oxide removal during the second process period.

In some examples, the actuator comprises one or more of an electrostatic actuator, electrochemical actuator, acoustic actuator, ultrasonic actuator, optical actuator, thermal actuator, or plasma-based actuator.

In some examples, the polishing system comprises a first polishing pad system and a second polishing pad system.

In some examples, the polishing system comprises a chemical mechanical polishing (CMP) system.

Another example aspect of the present disclosure is directed to a method for polishing a surface of a workpiece. The method includes providing a surface of a workpiece on a polishing pad. The method further includes imparting relative motion between the polishing pad and the workpiece. The method further includes providing an oxidizing material to the polishing pad. The method further includes providing an oxide removal material to the polishing pad in a time separated manner or a spatially separated manner relative to providing the oxidizing material to the polishing pad.

In some examples, the oxidizing material and the oxide removal material are provided in a spatially separated manner.

In some examples, providing the oxidizing material and the oxide removal material in a spatially separated manner includes providing the oxidizing material to a first zone on the polishing pad; and providing the oxide removal material to a second zone on the polishing pad.

In some examples, the first zone and the second zone are separated on the polishing pad by a separator.

In some examples, the separator comprises a fluid blade operable to inject a separator fluid to separate the first zone from the second zone.

In some examples, the separator fluid comprises air, water, liquid, or a gas.

In some examples, the separator comprises a lip that protrudes from the polishing pad.

In some examples, the lip comprises a polymer.

In some examples, the separator passes through a center of the polishing pad.

In some examples, the first zone is a different size relative to the second zone.

In some examples, the oxidizing material and the oxide removal material are provided in a time-separated manner.

In some examples, providing the oxidizing material and the oxide removal material in a time separated manner includes providing the oxidizing material to the polishing pad for a first process period, and providing the oxide removal material to the polishing pad for a second process period.

In some examples, there is no time overlap between the first process period and the second process period.

In some examples, the first process period and the second process period are separated by a time interval.

In some examples, the oxidizing material comprises one or more of hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate.

In some examples, the oxide removal material comprises one or more abrasive elements provided as part of a slurry.

In some examples, providing the oxidizing material or providing the oxide removal material comprises providing a fluid through one or more apertures through the polishing pad.

In some examples, providing the oxidizing material or providing the oxide removal material comprises providing a fluid through a fluid delivery outlet.

In some examples, imparting relative motion comprises rotating the polishing pad about a first axis.

In some examples, imparting relative motion comprises rotating the workpiece about a second axis.

In some examples, imparting relative motion includes rotating the polishing pad about a first axis; and rotating the workpiece about a second axis, the second axis being different from the first axis.

In some examples, the polishing pad is part of a chemical mechanical polishing (CMP) system.

Another example aspect of the present disclosure is directed to a method of polishing a workpiece. The method includes providing a surface of a workpiece on a polishing pad. The method further includes imparting relative motion between the polishing pad and the workpiece. The method further includes providing an actuatable material to the polishing pad. The method further includes activating the actuatable material in a pulsed manner to provide a time separation between a first process and a second process on the workpiece.

In some examples, activating the actuatable material in a pulsed manner includes pulsing an actuator to selectively activate the actuatable material.

In some examples, activating the actuatable material in a pulsed manner comprises pulsing the actuator to selectively activate the actuatable material to provide an oxidation process on the workpiece.

In some examples, activating the actuatable material in a pulsed manner comprises pulsing the actuator to selectively activate the actuatable material to provide an oxide removal process on the workpiece.

In some examples, the actuator comprises one or more of an electrostatic actuator, electrochemical actuator, acoustic actuator, ultrasonic actuator, optical actuator, thermal actuator, or plasma-based actuator.

In some examples, providing the actuatable material comprises providing a fluid through one or more apertures through the polishing pad.

In some examples, providing the actuatable material comprises providing a fluid through a fluid delivery outlet.

In some examples, imparting relative motion comprises rotating the polishing pad about a first axis.

In some examples, imparting relative motion comprises rotating the workpiece about a second axis.

In some examples, imparting relative motion includes rotating the polishing pad about a first axis; and rotating the workpiece about a second axis, the second axis being different from the first axis.

In some examples, the polishing pad is part of a chemical mechanical polishing (CMP) system.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A polishing system for a semiconductor workpiece, comprising:

a platen operable to rotate about an axis;

a polishing pad on the platen;

a workpiece carrier operable to bring a semiconductor workpiece into contact with the polishing pad;

a separator fixed to the polishing pad, wherein the separator is operable to separate the polishing pad into a first zone and a second zone; and a delivery system operable to deliver an oxidizing material to the first zone and an oxide removal material to the second zone such that an oxidation process may be implemented on the workpiece in a spatially separated manner relative to an oxide removal process.

2. The polishing system of claim 1, wherein the separator comprises a fluid blade operable to inject a separator fluid to separate the first zone from the second zone.

3. The polishing system of claim 2, wherein the separator fluid comprises air, water, liquid, or a gas.

4. The polishing system of claim 2, wherein the separator passes through a center of the polishing pad.

5. The polishing system of claim 1, wherein the separator comprises a lip that protrudes from the polishing pad.

6. The polishing system of claim 5, wherein the lip comprises a polymer.

7. The polishing system of claim 1, wherein the first zone is a different size relative to the second zone.

8. The polishing system of claim 1, wherein the oxidizing material comprises hydrogen peroxide, urea peroxide, potassium hypochlorite, sodium hypochlorite, ammonium persulfate, potassium peroxymonosulfate, sodium permanganate, potassium permanganate, potassium periodate, and/or potassium persulfate.

9. The polishing system of claim 1, wherein the oxide removal material comprises one or more of abrasive elements provided as part of a slurry.

10. The polishing system of claim 1, wherein the first zone comprises an oxidizing material on the polishing pad in the first zone.

11. The polishing system of claim 1, wherein the second zone comprises one or more abrasive elements, wherein the one or more abrasive elements comprise one or more of: (i) diamond; (ii) ceramic; (iii) metal nitride; (iv) metal oxide, (v) metal carbide; (vi) metalloid nitride; (vii) metalloid oxide; (viii) metalloid carbide; (ix) carbon group nitride; (x) carbon group oxide; or (xi) carbon group carbide.

12. The polishing system of claim 1, wherein the polishing system comprises a chemical mechanical polishing (CMP) system.

13. A method of polishing a workpiece, the method comprising:

providing a surface of a workpiece on a polishing pad;

imparting relative motion between the polishing pad and the workpiece;

providing an actuatable material to the polishing pad;

activating the actuatable material in a pulsed manner to provide a time separation between a first process comprising oxide removal on the workpiece and a second process without oxide removal on the workpiece by pulsing an actuator to selectively activate the actuatable material while imparting relative motion between the polishing pad and the workpiece; and wherein the actuator is one or more of an electrostatic actuator, electrochemical actuator, acoustic actuator, ultrasonic actuator, optical actuator, thermal actuator, or plasma-based actuator.

14. The method of claim 13, wherein activating the actuatable material in a pulsed manner comprises pulsing the actuator to selectively activate the actuatable material to provide an oxidation process on the workpiece.

15. The method of claim 13, wherein activating the actuatable material in a pulsed manner comprises pulsing the actuator to selectively activate the actuatable material to provide an oxide removal process on the workpiece.

16. The method of claim 13, wherein providing the actuatable material comprises providing a fluid through one or more apertures through the polishing pad.

17. The method of claim 13, wherein providing the actuatable material comprises providing a fluid through a fluid delivery outlet.

18. The method of claim 13, wherein imparting relative motion comprises rotating the polishing pad about a first axis or rotating the workpiece about a second axis.

* * * * *